United States Patent [19]

Fawcett et al.

[11] 4,192,721

[45] Mar. 11, 1980

[54] METHOD FOR PRODUCING A SMOOTH COHERENT FILM OF A METAL CHALCONIDE

[76] Inventors: William R. Fawcett; Andrzej S. Baranski, both of 30 Dean Ave., Guelph, Ontario, Canada, N1G 1K7

[21] Appl. No.: 32,762

[22] Filed: Apr. 24, 1979

[51] Int. Cl.[2] ..... C25D 3/02; C25D 9/08

[52] U.S. Cl. ..... 204/14 N; 204/56 R

[58] Field of Search ..... 204/14 R, 14 N, 56 R

[56] References Cited

U.S. PATENT DOCUMENTS

| | | | |
|---|---|---|---|
| 3,131,134 | 4/1964 | Micillo | 204/14 N |
| 3,616,280 | 10/1971 | Arnold | 204/14 N |
| 3,668,086 | 6/1972 | Hughes | 204/14 N |
| 3,953,234 | 4/1976 | Hoffmann | 204/14 N |
| 4,064,326 | 12/1977 | Manassen | 204/56 R |
| 4,086,101 | 4/1978 | Jordan | 204/56 R |
| 4,121,981 | 10/1978 | Ward | 204/56 R |
| 4,137,096 | 1/1979 | Maier | 204/56 R |

FOREIGN PATENT DOCUMENTS

| | | | |
|---|---|---|---|
| 2556716 | 6/1977 | Fed. Rep. of Germany | 204/56 R |

*Primary Examiner*—T. M. Tufariello
*Attorney, Agent, or Firm*—Ridout & Maybee

[57] ABSTRACT

Smooth coherent films of metal chalconides are electroplated onto a cathode from an electroplating bath comprising a solution of a metal salt and elemental chalcogen at elevated temperature and low current density.

30 Claims, 1 Drawing Figure

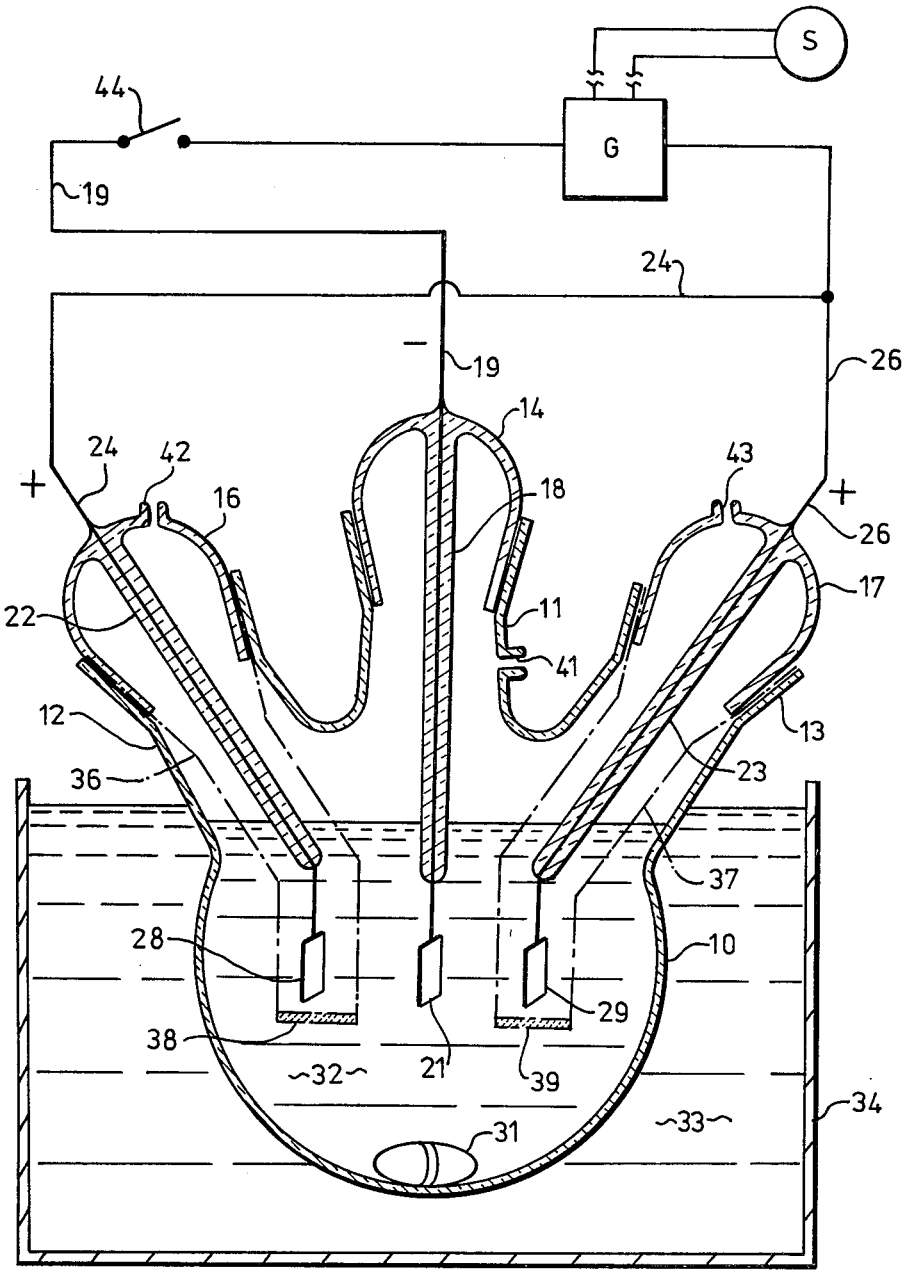
S
G
44
19
24
19
26
14
24
42
43
+
16
18
+
26
17
22
11
41
12
13
36
23
37
28
10
29
38
32
21
39
34
33
31

METHOD FOR PRODUCING A SMOOTH COHERENT FILM OF A METAL CHALCONIDE

BACKGROUND OF THE INVENTION

The present invention relates to a method for producing a smooth coherent film of a metal chalconide.

Metal chalconide films display a wide variety of properties that are useful in the electrical and chemical fields. Thus, for example, cadmium sulfide, mercury sulfide, bismuth sulfide and lead sulfide are n-type semiconductors of which thin films have application in solar energy collection devices; thallium sulfide and cuprous sulfide are p-type semiconductors of which thin films have similar uses. Nickel sulfide and cobalt sulfide are metallic conductors, and thin films of these materials have application as catalysts for redox processes involving sulfur compounds. Moreover, these compounds have application in the electronics industry and in the development of ion-selective electrodes for chemical analysis.

Up to the present time, thin films of these sulfide materials have been depositable by vapor deposition methods, but these methods are disadvantageous as they require the utilization of complex and expensive apparatus, or costly reagents may be required, and the energy costs of maintaining the necessary reduced-pressure environments and of converting these reagents from the solid to the vapor phase are relatively high.

SUMMARY OF THE INVENTION

The object of the present invention is to provide a process whereby at least some of the above-noted disadvantages of prior methods may be mitigated, or which will at least provide a useful alternative to the prior methods.

It has now been found that metal chalconides can be deposited at a cathode as a smooth, coherent film by conducting an electroplating process at low current densities employing as electrolyte a metal salt dissolved in an organic polar solvent, in which is also dissolved chalcogen in elemental form, with the electrolytic bath being maintained at elevated temperature.

In accordance with the invention, there is provided a method for producing a smooth coherent film of a metal chalconide of which the metal moiety is a metal selected from the group consisting of Cd, Pb, Hg, Cu, Bi, Co, Ni, and Tl and the chalconide moiety is a chalcogen selected from the group consisting of S, and Se, comprising the steps of providing an electrolytic bath comprising an organic polar solvent having dissolved therein (a) a salt of said metal that is ionised and is electrically conductive in solution in said solvent and (b) said chalcogen in elemental form; maintaining the bath at elevated temperature; subjecting the bath to electrolysis at a current density that is sufficiently low with respect to the surface area of the cathode that a smooth coherent film of said chalconide is deposited on the cathode; and continuing the electrolysis until a desired thickness of film has built up on the cathode.

BRIEF DESCRIPTION OF THE DRAWINGS

The accompanying drawings illustrate, partly schematically, and partly in vertical section, one form of apparatus for use in carrying out the present method.

DESCRIPTION OF THE PREFERRED EMBODIMENTS

In general, the metal chalconides of which thin films are prepared by the techniques of the present invention, may be represented by the general formula $$M_m X_x$$

wherein M is Cd, Pb, Hg, Cu, Bi, Co, Ni, or Tl; X is S or Se and m and x are integers satisfying the valencies of the chalcogen and the metal, respectively.

In conducting the present film-producing method, there is employed an electrolytic bath comprising an organic polar solvent having dissolved therein an ionised, electrically-conductive salt of the metal M, and having also dissolved therein the chalcogen X in elemental form. The bath is maintained at an elevated temperature (above ambient temperature) as this is conducive to the formation of smooth coherent films of the metal chalconide at increased rates of deposition, as discussed in more detail below. Electrolysis is conducted at a low current density such that a smooth, coherent film of the chalconide is electroplated out on the cathode. The electrolysis is conducted until such time as the required thickness of deposit of film, which deposits out on the cathode, is built up.

Although the mechanism of the electroplating process is not at present fully understood, it is suggested that this consists in electrolytic reduction of the cation of the metal M to an active form at the surface of the cathode. The active metal atom reacts rapidly with the chalcogen X dissolved in the organic polar solvent to form the metallic chalconide. Thus, in the case of, for example, a metal that is divalent, the equations for the reaction at the cathode are as follows:

$$M^{++} + 2e \rightarrow M^* \quad (1)$$

$$M^* + X \rightarrow MX \quad (2)$$

where M* represents the active metal atom.

The nature of the reaction at the anode is not presently well understood, but appears to involve oxidation of the organic polar solvent.

It has been found that when the current density at the cathode surface is maintained sufficiently low, so that the rate of formation of active metal atoms M* at the cathode in accordance with equation (1) is relatively slow, then the rate of the chalconide-forming reaction in accordance with equation (2) can proceed sufficiently rapidly that there is substantially no formation of free metal, and a smooth, coherent deposit of the metal sulfide or other chalconide is obtained. However, at excessively high current densities, the rate of formation of active species M* is so high that appreciable quantities of free metal are deposited at the cathode, so that a matt, powdery, or non-glassy deposit is obtained, owing to inclusions of free metal in the deposit. Moreover, at excessively high current densities, there is the tendency for dendritic growth of the chalconide deposit, leading to the formation of non-coherent films.

As noted above, the metal chalconides that have useful electrical and chemical properties, and to which the present electroplating method is applicable comprise the chalconides, and especially the sulfides, of the metals Cd, Pb, Hg, Cu, Bi, Co, Ni, and Tl. It may be noted that the said metals are included in the class of metals that are depositable as sulfides in Groups I, II and III of the Standard Scheme of Qualitative Analysis e.g. as set out in Qualitative Analysis and the Properties of Ions in Aqueous Solutions, Slowinski, E. J. et al, 1971, W. B. Saunders Company. It may be further noted that in Group II, metals which form amphoteric sulfides can not be deposited i.e. it is not possible to deposit SnS, or $Sb_2S_3$. Secondly, metal ions in Group III which have extremely negative standard potentials are not easily deposited as the sulfide. In this regard, it should be noted that Zn, Al and Mn are Group III metal ions which cannot be as easily deposited as the corresponding sulfides.

Elemental tellurium is poorly soluble in organic solvents and therefore the present electroplating method is not conveniently applicable to the production of metal tellurides.

As noted above, in conducting the electroplating process of the invention, the current density must be limited to avoid an excessive rate of reduction of the metal anion, leading to production of free metal inclusions and other difficulties. It is therefore preferred to conduct the electroplating process under controlled, galvanostatic conditions. The maximum current density that can be employed with any given reaction system can be determined empirically in each case, but usually the current density will not exceed about 5 mA per square centimeter of the surface of the cathode, and in the preferred forms of the invention, the said current density is less than about 3 mA per square centimeter.

It has been found that the maximum current density that can be used in each case is dependent upon the temperature at which the electrolytic bath is maintained, and upon the concentration of chalcogen dissolved in the electrolytic bath. The greater the temperature and the greater the concentration of the dissolved chalcogen, the greater the permissible limit of current density. Advantageously, the electrolytic bath is maintained at a temperature of at least 80° C., and the bath contains dissolved therein at least about 0.005 moles per liter of said chalcogen X. At temperatures and concentrations of chalcogen less than these, the rate of the chalconide-forming reaction in accordance with equation (2) is excessively low, and therefore excessively low current densities have to be employed to avoid free metal formation, so that a smooth, coherent deposit is obtained. At these excessively low current densities, the rates of deposition of the metal chalconides are very slow, and greatly extended periods of time are required for build-up of satisfactory thicknesses of the film. Preferably, the deposition is conducted at a temperature of at least about 90° C., and said chalcogen X is present in an amount of at least about 0.05 moles (gram atoms of said chalcogen) per liter, more preferably at least about 0.1 moles per liter of the bath.

Owing to the high energy costs of maintaining the bath at greatly elevated temperatures, the bath is desirably operated at a temperature not much greater than about 150° C. The maximum temperature that is employable, and the maximum concentration of chalcogen that is used are, of course, limited in practice only by the temperature of decomposition of the organic polar solvent, and by the limit of solubility of the chalcogen in the solvent.

The preferred polar organic solvents are solvents that are capable of dissolving large amounts of the chalcogens sulfur and selenium, and that have relatively high boiling points so that there is no need to pressurize the apparatus to super-atmospheric pressures in order to achieve satisfactorily elevated bath temperatures without boiling the solvent. As noted above, it is normally desired to operate the process at temperatures in the range of about 90° to about 150° C., and therefore the preferred solvents are liquids having boiling and decomposition points in excess of 150° C. at normal atmospheric pressure.

The solvent should be one in which the solubility of the chalcogen is at least about 0.005 moles per liter, and as indicated above, preferably at least about 0.05 moles per liter, in order that an adequate concentration of chalcogen may be present to avoid formation of free metal inclusions at practicable current densities. The solvent can be a protic solvent or an aprotic solvent. The presently preferred solvents are dimethylsulfoxide, dimethylformamide, ethylene glycol, propylene carbonate, and mixtures thereof. The presence of large amounts of dissolved water in the solvent is undesirable, as this reduces the solubility of the chalcogen therein. The use of elevated temperatures for conducting the process has the additional advantage that the moisture content of the bath is maintained at a low level, as at elevated temperatures there is little tendency for hygroscopic absorption of moisture into the solvent from the atmosphere, and any residual moisture tends to be volatilized and expelled from the bath. Although moisture contents of up to about 20% by weight of the bath can be tolerated, the moisture content is advantageously no more than about 10%, more desirably less than about 5% of the weight of the bath. In the presently preferred forms of the invention, the solvents that are employed are substantially anhydrous.

It has been found that certain of the preferred solvents, namely dimethylsulfoxide and dimethylformamide, and of these more notably the dimethylsulfoxide, exhibit a surface activity at the cathode, discussed in more detail below, that is especially beneficial for the deposition of the metal chalconides in smooth, coherent film form, and these solvents are for that reason especially preferred.

In general, the salt of the metal M that is employed can be any salt that is soluble in the organic polar solvent and that exists in solution therein in the form of ions, so that it can serve as an electrically-conductive electrolyte in solution in the solvent. Desirably, the metal salt is a salt of a strong acid that is non-reactive with respect to the solvent and the chalcogen. Thus, salts of strong oxidizing or reducing acids such as sulfates, sulfites, nitrites and hypohalites are not preferred, as they may exert an oxidizing or reducing action on the chalcogen, or may exert an oxidizing action on the organic polar solvent. Desirably the metal salt is soluble in the solvent to an extent of at least about 0.01 moles per liter of the bath. Below this amount, the over potential for the reduction of the metal cation in accordance with equation (1) may be so negative that other, undesired electroreduction processes may occur if the reaction is conducted, as is normally desired, under galvanostatic conditions, due to the occurrence of these undesired side-reactions preferentially to the electro-reduction of the metal cation. The upper limit for the content of metal salt is dictated in practice by the limit of the solubility of the salt in the solvent. Typically the salt will be present in an amount of up to about 1 mole per liter of the bath, and more typically is present in an amount of about 0.02 to about 0.8 moles per liter of the bath.

The preferred metal salts are halides i.e. chlorides, bromides, and iodides, and cyanides, and thiocyanates. These anions are relatively unreactive with the preferred organic polar solvents and with the chalcogens, and it has been found that certain of these also exhibit a surface active effect at the cathode that is exceptionally beneficial for the formation of a satisfactory smooth, coherent film of the metal chalconide.

In particular, the presence of halide ions and more particularly iodide ions in the electrolytic bath is especially beneficial to the formation of smooth, coherent metal chalconide films. Iodine ions are known to be strongly adsorbed at metal surfaces, and it is suggested that in the process of the present invention, the addition of iodide anion results in adsorption of the iodide anions on the surface of the cathode, thus leading to localized negative charges on the cathodic surface that influence the attraction of the cations of the metal M to the cathodic surface and their discharge to provide the reactive species M* . Bromide ions, and to a lesser extent, chloride ions, are also strongly adsorbed on the surface of the cathode, and exhibit a similar surface active effect. Cyanide and thiocyanate ions also exhibit some degree of desirable surface activity, but to a lesser extent than the halides.

As noted above, certain of the preferred solvents exhibit jointly with certain of the aforementioned anions a beneficial surface active effect that is conductive to the formation of smooth, coherent films. Thus, it has been found that where dimethylsulfoxide is employed as solvent, satisfactory smooth, coherent films can be obtained of chalconides of each of said metals Cd, Pb, Cu, Bi, Co, Ni, and Tl in the presence of an effective, surface active amount of chloride anion. It may be noted that the chloride anion may be present in the bath due to the use of a chloride of said metal M as the metal-containing electrolyte that is dissolved in the bath. In the case of each of said preferred solvents dimethylsulfoxide, dimethylformamide, ethylene glycol, and propylene carbonate, a satisfactory chalconide film can be obtained by adding an effective surface-active amount of iodide anion. As noted above, the addition of iodide anion is not required in dimethylsulfoxide solutions where the chloride anion normally added as part of the metallic salt is sufficiently surface active. Further, iodide anion is not required in the case of deposition of nickel or cobalt chalconide deposited from dimethylformamide solutions.

Where a source of surface-active anion is added in addition to the quantity of surface-active anion, if any, that may be present in the salt of the metal M that is dissolved as metal-containing electrolyte, said anion is desirably added in the form of a relatively inert salt of an alkali metal e.g. sodium, potassium, rubidium, or of an alkaline earth metal e.g. magnesium, calcium, strontium, or barium.

In general, the effective amount of surface-active anion, if any, that is required will be in the range of from about 0.01 to about 1.5 moles per liter of bath, more preferably about 0.05 to about 1.2 moles per liter.

In the case of electro deposition of mercuric sulfide (HgS) it is desirable to employ added iodine anion, owing to the highly positive standard potential of the reduction reaction $$Hg^{++}+S+2e \rightarrow HgS$$

Hence, in the absence of iodide ion, the potential that is required in order to achieve electrodeposition of the sulfide is of such magnitude that the organic solvent would in most cases be oxidized.

However, in the presence of iodide anion, the reduction reaction that occurs in $HgI_2+S+2e \rightarrow HgS+2I^-$, and as the standard potential for this reaction is much more electronegative, it can take place without risk of oxidation of the solvent.

Where the electrolytic bath contains iodide anion, it is desirable to avoid contact of the anode with the iodide-containing solution as the iodide anion may be oxidized to elemental iodine and this is troublesome not only because of the evolution of large quantities of noxious iodine vapour, but also because of the resultant depletion of the iodide content of the bath. Separation of the anolyte from the catholyte can be achieved using any convenient means that permit electrical contact between the anode and the main body of the electrolytic bath, while preventing gross mixing of the main body of the electrolytic bath with the environment around the anode. One convenient method is to immerse the anode in a solution formed from the same solvent used in the main body of the bath and having dissolved therein any suitable relectrically conductive salt that is inert with respect to the anode potential, and to separate this solution from the main body of the bath using a liquid-porous barrier that prevents gross mixing of the solution with the main body of the bath.

Separation of the anolyte from the catholyte is also desirable where the metal M has variable-valency ions that are oxidizable and reducible at the anode and cathode potentials achieved in the electroplating process, otherewise the efficiency of the electroplating process may suffer due to undesired oxidizing and reducing side-reactions for example, in the case of deposition of cuprous sulphide, it is desirable to separate the anolyte from the catholyte to reduce the tendency for cuprous ion to be oxidized to cupric ion at the anode, which cupric ion on migration to the cathode will re reduced to cuprous ion before being discharged as the active copper metal species.

Examples of suitable conductive substrates on which the films may be deposited in accordance with the invention, and which may therefore be employed as the cathode in the above-described process include nickel, stainless steel, gold, platinum, tin oxide coated glass, and graphite. Where the deposition is conducted on nickel or stainless steel, owing to the passivating oxide film that is normally present on these metals, a strong adherency of the chalconide film to the substrate is not obtained, and to render the deposit non-peelable, the deposit must be stabilized by annealing it at a temperature of about 200°to 250° C., preferably about 240° C., in an inert atmosphere.

Adherent, non-peelable deposits can be obtained directly on inert metal such as platinum and gold without the need for any subsequent annealing step.

The metal chalconide films that are obtained with the present process can range in thickness from very thin, monomolecular layers up to films of considerable thickness. The thickness of the deposit can be closely controlled, as the process proceeds quantitatively according to the current passed, and therefore at very low current densities, the thickness of the film can be controlled so that films of an appropriate thickness can be obtained by passing the calculated amount of current for the appropriate length of time. With the non-conducting or semi-conducting chalconides, as the thickness of the deposit increases, the electrical resistance increases, and therefore to some extent this controls the thickness that can be achieved in each particular case. However, with some chalconides, e.g. cadmium sulfide, which exhibit photoelectric properties, the conductivity of the film can be increased by irradiating the growing face of the film during the deposition process, so that thicker films can be deposited. In most cases, it is not desired to achieve a thickness of greater than about $10^{-4}$ meters, and for most purposes, films of thickness from about $5\times10^{-7}$ to about $10^{-5}$ meters are preferred.

In the case of some of the metal chalconides, when films of greater thickness are deposited, there is a greater tendency for minute surface cracks to form in the electrodeposit. These minute cracks, which can be observed microscopically, and which are similar to surface cracks that are observed with films obtained from the conventional vapour deposition process, do not extend completely through the deposit to the substrate, but extend through only a portion of the deposit from the surface thereof. It has been found that the tendency for surface cracking can be reduced by interrupting the passage of current for brief periods during the electrodeposition process. It has been found that any interruption of the electrodeposition process, for any duration, and at any frequency of occurrence, improves the quality of the electrodeposited film in reducing or preventing the formation of surface cracks. Merely by way of example, it may be mentioned that in the electrodeposition of cadmium sulfide, a significant reduction in the amount and extent of surface cracking can be achieved by interrupting the passage of current for a few seconds every few seconds, e.g. for 5 seconds every 5 seconds. Although the reasons why this reduces the tendency for surface cracking are not fully understood, it is suggested that the surface cracks arise as a result of piezo-electrically-produced stresses acting on the chalconide film under the locally-existing electrical field at the surface of the cathode. By interrupting the passage of current for brief periods, it appears that this gives an opportunity for the compressed or stressed portions of the deposited film to relax, thus avoiding the build-up of strains which may result in surface cracking.

The present electrodeposition method can be used to co-deposit two or more metallic chalconides or to deposit metallic chalconides sequentially. For example, by interrupting the electrodeposition process, and recommencing the process employing another appropriately selected metal cation, it may be mentioned that, for example, cadmium sulfide (CdS) can be deposited on mercuric sulfide (HgS) and cuprous sulfide ($Cu_2S$), and cuprous sulfide ($Cu_2S$) can be deposited on cadmium sulfide (CdS). The present process can also be used to add a minority dopant to a semi-conducting metallic chalconide film.

By reason of its lack of toxicity and its relatively low cost, the preferred chalcogen for use in the present invention is sulfur. As will be understood by those skilled in the art, the chalcogens selenium and tellurium are closely analagous to sulfur in their properties, and may be substituted for sulfur in the process of the present invention making only such changes or modifications to the process as will readily be apparent to those skilled in the art as being necessary. Thus, for example, when the present method is used to deposit metallic selenides, since the solubility of elemental selenium is much less than that of sulfur in polar organic solvents, the electrodeposition of metallic selenides should be carried out at a lower current density than that employed for metallic sulfides, to avoid an excessive rate of production of active metal atoms species M* relative to the concentration of dissolved chalcogen, so that free metal inclusions are not formed and the production of non-glassy non-coherent films is avoided.

Referring now in more detail to the accompanying drawings, these illustrate, for the purposes of exemplification only, one form of apparatus that may be used for conducting the present process. The apparatus comprises a three-necked glass vessel 10 having a central neck 11 and necks 12 and 13 disposed symmetrically on either side. Electrode-holding glass fittings 14, 16, and 17 are received in the necks 11, 12 and 13 respectively. The central fitting 14 carries a glass stem 18 through which passes a lead 19 to the cathode 21, and fittings 16 and 17 carry glass stems 22 and 23, through which pass leads 24 and 26 to a pair of anodes 28 and 29, respectively.

A magnetic stirrer body 31 is provided for stirring the electrolytic bath that is contained in the vessel 10. The bath 32 contains the polar organic solvent having dissolved therein the salt of the metal M and the elemental chalcogen X.

The temperature of the vessel 10 is controlled by having it immersed in an oil bath 33 maintained at a constant known temperature, contained within a suitable vessel 34.

Provision can be made for separation of the anolyte and the catholyte by surrounding each anode 28, 29 with glass tubes (shown in broken lines 36, 37). Each of the tubes 36 and 37 is closed at its bottom with a fritted glass disk 38, 39 of medium porosity that permits electrical conduction between the liquids inside the tubes 36, 37 and the main body of the bath 32, while preventing or restricting gross mixing of the two liquids. Where separation of the anolyte from the catholyte is required, the interior of the tubes 36 and 37 will be filled with a conductive liquid compatible with the main body of the bath 31.

In order to avoid excessive build-up of pressure within the vessel 10, vent apertures 41, 42, and 43 may be provided in the central neck 11 and in the glass fittings 16 and 17, respectively.

The anode leads 24 and 26 are connected in common through the output of a conventional galvanostat G, and through a switch 44 to the cathode lead 19. The galvanostat is connected through leads 46, 47 to a D.C. source S. The galvanostat is programmable to supply a constant current in the desired range. For the purposes of the Examples set out in more detail hereinafter, it is desired that the galvanostat G provide an output within the range of about 1 mA to about 5 mA.

The function of the galvanostat G is that, once it is set to a selected amperage, it automatically adjusts the volts supplied across its output so that a constant amperage is delivered regardless of changes in the resistance load that may occur. In the Examples hereinafter, there is employed a galvanostat G and source S such that applied voltages up to about 70 volts can be obtained.

Some non-limiting Examples of process in accordance with the invention will now be given.

In each of the Examples, apparatus as illustrated in the accompanying drawings is employed, using 100 ml of organic polar solvent as the bath 32, having the salts and elemental chalcogens specified dissolved therein in the amounts indicated.

In the Examples, DMSO represents dimethylsulfoxide, DMF is dimethylformamide, and PC is propylene carbonate.

The cathode 21 consists in each case of a square piece of metal foil 1 cm×1 cm immersed in the bath 32. The anodes 28 and 29 are pieces of platinum foil of the same size as the cathode, each separated from the cathode 21 by a distance of 2 cm and mounted so that their surfaces are parallel to those of the cathode 21. This geometry ensures uniform current density, and thus uniformity of thickness and of other characteristics of the chalconide film that is electrodeposited on the surfaces of the cathode 21. In instances where separation of the anolyte and catholyte are required, the glass tubes 36, 37 are employed, each ending in a fritted glass disk 38, 39 of medium porosity. The tubes 36, 37 are filled with a saturated solution of KCNS dissolved in the same solvent as used in the main body of bath 32. The bath 32 is stirred using the magnetic stirrer body 31, and its temperature is controlled at the temperature indicated by immersing it in the oil bath 33 maintained at the desired constant temperature. No protective atmosphere is used in the vessel 10.

In each case, analytical grade solvents are used without further purification. Commercially available analytical grade salts can be used as the metal salts that are dissolved in the bath. Prior to use the salts were dried under vacuum at a temperature of 150° C. The selenium used is prepared in the red allotropic form by reducing $Na_2SeO_3$ with $Na_2SO_3$ in a solution of 1 molar HCL. The product is carefully washed with distilled water and is dried at room temperature. The electroplating solutions used in the bath 32 are stable for several months. They may be stored in a covered glass container with no special precautions against the normal ambient atmosphere.

During the electrolysis, a constant current is supplied from the galvanostat G, at the amperage specified.

EXAMPLE 1

In order to deposit CdS, a bath of the following composition is employed.

DMSO: 100 mls
S: 0.6 g.
$CdCl_2$: 1.0 g.

The current density is 2.5 mA $cm^{-2}$, and the temperature is maintained at 110° C.

EXAMPLE 2

In order to deposit CdS, a bath of the following composition is employed.

DMF: 100 mls
S: 0.6 g.
$CdCl_2$: 1.0 g.
KI: 1.0 g.

The current density is 2.5 mA $cm^{-2}$, and the temperature is maintained at 120° C. Owing to the presence of iodide ion, the anolyte is separated from the catholyte.

EXAMPLE 3

In order to deposit CdS, a bath of the following composition was employed.

DMF: 15 mls
PC: 85 mls
S: 0.6 g.
$CdCl_2$: 1.0 g.
KI: 1.0 g.

The current density and temperature are maintained as in Example 1. The anolyte is separated from the catholyte, to avoid iodine production at the anode.

EXAMPLE 4

In order to deposit CdS, the following bath composition is employed.

Ethylene Glycol: 100 mls
S: 0.6 g.
$CdCl_2$: 1.0 g.
KI: 5.0 g.

The current density is maintained at 1.5 mA $cm^{-2}$, the temperature is maintained at 130° C. Owing to the presence of iodide ion, the anolyte must be separated from the catholyte.

EXAMPLE 5

In order to deposit CdSe, a bath with the following composition is employed.

DMF: 100 mls
Se: saturated solution
$CdCl_2$: 1.0 g.
KI: 1.0 g.

The current density is maintained at 0.5 mA $cm^{-2}$, and the temperature is maintained at 120° C. Anolyte is separated from the catholyte.

EXAMPLE 6

In order to deposit HgS, a bath with the following composition is employed.

DMSO: 100 mls
$HgI_2$: 2.3 g.
KI: 0.8 g.
S: 0.6 g.

The current density is 2.5 mA $cm^{-2}$, and the temperature is 110° C. Anolyte must be separated from the catholyte.

EXAMPLE 7

For depositing $Cu_2S$, a bath of the following composition is employed.

DMSO: 100 ml
CuCN: 0.5 g.
S: 0.6 g.
CsCl: 0.5 g.

The current density and temperature are maintained as in Example 6. The anolyte must be separated from the catholyte, to avoid oxidation of the cuprous ion to cupric ion at the anode.

EXAMPLE 8

In order to deposit $Tl_2S$, a bath of the following composition is employed.

DMSO: 100 ml
TlCNS: 1.5 g.
S: 0.6 g.

The current density and temperature are maintained as in Example 6.

EXAMPLE 9

In order to deposit $Bi_2S_3$, a bath of the following composition is employed.

DMSO: 100 ml
$BiCl_3$: 1.5 g.
S: 0.6 g.

The temperature and current density are as in Example 6.

EXAMPLE 10

To deposit PbS, a bath having the composition is indicated below.

DMSO: 100 ml
$PbCl_2$: 1.5 g.
S: 0.6 g.

The temperature and current density are maintained as in Example 6.

EXAMPLE 11

To deposit NiS, a bath having the composition indicated below is employed.

DMF: 100 ml
$NiCl_2$: 0.5 g.
S: 0.6 g.

The temperature and current density are maintained as in Example 6.

EXAMPLE 12

In order to deposit CoS, a bath having the composition indicated below is employed.

DMF: 100 ml
$CoCl_2$: 0.5 g.
S: 0.6 g.

The temperature and current density are maintained as in Example 6.

In each of the Examples discussed above, the electrical properties of the metal chalconide films that are obtained are the same as those of films obtained by prior methods. Thus, films of cadmium sulphide (CdS), cadmium selenide (CdSe), bismuth sulphide ($Bi_2S_3$), mercury sulphide (HgS) and lead sulphide (PbS) obtained by the present invention are n-type semiconductors. Nickel sulphide (NiS) and cobalt sulphide (CoS) films obtained by the invention have metallic type conductivity; these compounds are also catalysts for electrode processes involving sulphur in low oxidation states. Cuprous sulphide ($Cu_2S$) and thallium sulphide ($Tl_2S$) films as obtained by the present process are p-type semiconductors.

In each case, films ranging in thickness from 1 or more molecular monolayers up to, for example, about $10^{-5}$ meters in thickness can readily be obtained by continuing the electrolysis for the period of time that is calculated to discharge the requisite quantity of metal cation.

We claim:

1. A method for producing a smooth coherent film of a metal chalconide of which the metal moiety is a metal selected from the group consisting of Cd, Pb, Hg, Cu, Bi, Co, Ni, and Tl, and the chalconide moiety is a chalcogen selected from the group consisting of S, and Se, comprising the steps of providing an electrolytic bath comprising an organic polar solvent having dissolved therein (a) a salt of said metal that is ionised and is electrically conductive in solution in said solvent and (b) said chalcogen is elemental form; maintaining the bath at elevated temperature; subjecting the bath to electrolysis at a current density that is sufficiently low with respect to the surface area of the cathode that a smooth coherent film of said chalconide is deposited on the cathode; and continuing the electrolysis until a desired thickness of film has built up on the cathode.

2. A method according to claim 1 in which the solvent is selected from the group consisting of dimethylsulfoxide, dimethylformamide, ethylene glycol, propylene carbonate, and mixtures thereof.

3. A method as claimed in claim 1 wherein said metal salt (a) is a salt of a strong acid that is non-reactive with respect to the solvent and the chalcogen.

4. A method as claimed in claim 3 wherein said salt (a) is selected from the group consisting of metal halides, metal cyanides, and metal thiocyanates.

5. A method as claimed in claim 1 wherein said salt (a) is present in an amount of from about 0.01 mole per liter of the bath up to the limit of solubility of the salt in said solvent.

6. A method as claimed in claim 5 wherein said metal salt concentration is about 0.02 to about 0.8 mole per liter.

7. A method as claimed in claim 1 wherein said chalcogen (b) is present in an amount of from about 0.005 moles per liter up to its limit of solubility in said solvent.

8. A method as claimed in claim 7 wherein the amount of said chalcogen (b) is at least about 0.05 moles per liter.

9. A method as claimed in claim 8 wherein the amount of said chalcogen (b) is at least 0.1 moles per liter.

10. A method as claimed in claim 1 wherein the bath is maintained at a temperature of from 80° C. up to the decomposition temperature of said solvent.

11. A method as claimed in claim 1 wherein said temperature is about 90° C. to about 150° C.

12. A method as claimed in claim 1 wherein said current density is less than about 5 mA per sq. cm of the surface area of the cathode.

13. A method as claimed in claim 12 wherein said current density is less than about 3 mA per sq. cm.

14. A method as claimed in claim 1 wherein said bath contains dissolved therein an effective amount of a surface-active anion that is strongly adsorbed on the surface of said cathode.

15. A method as claimed in claim 14 wherein said anion is selected from the group consisting of halide ions, cyanide ions, and thiocyanate ions.

16. A method as claimed in claim 15 wherein said anion is iodide.

17. A method as claimed in claim 14 wherein the content of said anion is from about 0.01 to about 1.5 mile per liter of the bath.

18. A method as claimed in claim 17 wherein said content is about 0.05 to about 1.2 mole per liter.

19. A method as claimed in claim 1 wherein said metal salt (a) is a metal chloride and the solvent is dimethylsulfoxide.

20. A method as claimed in claim 1 wherein said metal salt (a) is selected from the group consisting of nickel and cobalt salts, and said solvent is dimethylformamide.

21. A method as claimed in claim 1 for producing a film of Hg chalconide wherein said metal salt (a) is Hg $I_2$.

22. A method as claimed in claim 1 wherein said electrolysis is continued until a film of thickness ranging from a monomolecular layer up to about $10^{-4}$ meters is produced.

23. A method as claimed in claim 22 wherein said thickness is about $5\times10^{-7}$ to about $10^{-5}$ meters.

24. A method as claimed in claim 1 wherein the cathode is of a material selected from the group consisting of nickel, stainless steel, gold, platinum, and graphite.

25. A method as claimed in claim 24 wherein the cathode is a metal having a passivating oxide layer, and including the step of annealing the deposited film at a temperature of about 200° to 250° C. in an inert atmosphere to render the film non-peelable from the substrate.

26. A method as claimed in claim 25 wherein the annealing temperature is about 240° C.

27. A method as claimed in claim 25 wherein the cathode material is nickel or stainless steel.

28. A method as claimed in claim 1 wherein said bath contains an anion that is dischargeable at the potential of the anode employed in the electrolysis and the anolyte is separated from the catholyte in said bath.

29. A method as claimed in claim 1 wherein said bath contains a cation of a variable valency metal that is oxidizable at the potential of the anode employed in the electrolysis and the anolyte is separated from the catholyte in said bath.

30. A method as claimed in claim 28 or claim 29 wherein there is employed an anode immersed in a solution comprising said organic polar solvent having dissolved therein a salt that is non-reactive at said anode potential, the solution being separated from the bath by a liquid-pervious porous barrier preventing gross mixing of the solution and the bath.

* * * * *